US006158307A

United States Patent [19]

Lamond et al.

[11] Patent Number: 6,158,307

[45] Date of Patent: Dec. 12, 2000

[54] SHOCK ABSORPTION SYSTEM FOR A STRIKING TOOL

[75] Inventors: Donald R. Lamond, Lynbrook, N.Y.; Bert D. Heinzelman, Tenafly, N.J.; Christopher Claypool, Hoboken, N.J.; Jose L. Correa, Bergen, N.J.; David L. French, Stamford, Conn.

[73] Assignee: General Housewares Corporation, Terre Haute, Ind.

[21] Appl. No.: 09/304,828

[22] Filed: May 5, 1999

[51] Int. Cl.[7] ..... B25D 1/22

[52] U.S. Cl. ..... 81/22; 81/20

[58] Field of Search ..... 81/19, 20, 22; 30/308.1

[56] References Cited

U.S. PATENT DOCUMENTS

| | | | |
|---|---|---|---|
| D. 267,469 | 1/1983 | Crowder . | |
| D. 275,261 | 8/1984 | Crowder . | |
| D. 289,729 | 5/1987 | Porter . | |
| D. 322,021 | 12/1991 | Hsu . | |
| D. 325,863 | 5/1992 | Chen . | |
| D. 347,780 | 6/1994 | Hreha . | |
| D. 369,734 | 5/1996 | Sanger . | |
| D. 376,087 | 12/1996 | Spirer . | |
| D. 376,089 | 12/1996 | Allen . | |
| D. 381,884 | 8/1997 | Spirer . | |
| 619,608 | 2/1899 | Penny . | |
| 785,921 | 3/1905 | Springer . | |
| 2,765,827 | 10/1956 | Hall . | |
| 2,879,030 | 3/1959 | Loretitsch . | |
| 2,884,969 | 5/1959 | Lay . | |
| 2,983,297 | 5/1961 | Wilson . | |
| 3,779,296 | 12/1973 | Echeverria | 81/22 |
| 3,833,037 | 9/1974 | Fish | 81/20 |
| 3,874,433 | 4/1975 | Sherpherd, Jr. et al. | 81/22 X |
| 4,089,356 | 5/1978 | O'Connor | 81/22 |
| 4,165,771 | 8/1979 | Curati, Jr. | 81/20 |
| 4,188,703 | 2/1980 | Fish . | |
| 4,576,361 | 3/1986 | Knight . | |
| 4,723,582 | 2/1988 | Caspall . | |
| 5,029,496 | 7/1991 | Catania . | |
| 5,289,742 | 3/1994 | Vaughan, Jr. . | |
| 5,588,343 | 12/1996 | Rust et al. . | |
| 5,992,270 | 11/1999 | Hedelinl et al. | 81/22 |

*Primary Examiner*—David A. Scherbel
*Assistant Examiner*—Anthony Ojini
*Attorney, Agent, or Firm*—McDermott, Will & Emery

[57] ABSTRACT

A system for absorbing shock including a resilient member positioned between a portion of the head and a portion of the shaft of the tool. The resilient member dampens and absorbs vibration travelling from the head to the shaft and reverberations travelling through the tool. The system also includes a shock-absorbing member having an internal portion positioned within a cavity in the head of the tool and an external portion positioned on an upper surface of the head that dampens and absorbs vibration travelling within the head and reverberations travelling through the tool. The system further includes a bonding material filling spaces with the cavity and a channel within the head that further dampens and absorbs vibration travelling from the head to the shaft and reverberations travelling through the tool. The system includes a handle portion that has a soft elastomeric outer coating that provides a comfortable grip to the user and hinders vibration from travelling from the shaft to the hand of the user.

18 Claims, 5 Drawing Sheets

SHOCK ABSORPTION SYSTEM FOR A STRIKING TOOL

FIELD OF THE INVENTION

The present invention relates to hand tools, and in particular, to a shock absorption system for a striking tool having a head connected to a shaft.

BACKGROUND OF THE INVENTION

Conventional striking tool, such as hammers, axes, sledgehammers, picks, etc., generally include a head portion mounted to one end of a shaft. Typically, the head portion is rigidly mounted to the shaft so that the force exerted on the striking tool by the user is efficiently transmitted through the shaft to the head of the tool. By rigidly attaching the head to the shaft, the force is transmitted through the shaft and to the head so that the contact surface of the head strikes an object with full force. Additionally, the head is typically rigidly attached to the shaft in order to ensure that the head remains fixed to the shaft after repeated striking of the tool on various hard objects.

While rigid attachment of the head of a striking tool to the shaft provides for an efficient transfer of energy to the object being struck by the tool, the rigid attachment produces a tool with several distinct disadvantages. One undesirable result of rigidly mounting the head to the shaft is that any vibration produced when the head strikes an object travels through the head and down the shaft to the hand of a user of the tool. Additionally, any reverberation of the vibration within the head also travels through the shaft to the hand of the user. Such vibrations in the shaft can cause great discomfort to the user and can be detrimental not only to the health of professionals who use striking tools repeatedly for extended periods of time, but also to non-professionals who occasionally uses striking tools for small jobs.

Consequently, a need exists for a striking tool that is constructed to reduce the amount of vibration that travels from the head to the shaft of the strking tool. Such a striking tool should be uniquely constructed to include a vibration dampening device that is positioned within the joint between the head and the shaft. Furthermore, there is a need for a striking tool that dampens the reverberation of vibration within the head of the striking tool, thereby further reducing the amount of vibration that travels from the head to the shaft of the striking tool.

SUMMARY OF THE INVENTION

The present invention provides a shock absorption system for a striking tool that reduces the amount of vibration travelling from a head of a striking tool to a shaft. The present invention achieves this result by providing vibration dampening members between the head and the shaft, and within a cavity in the head.

The present invention advantageously provides a shock absorption system that includes a resilient member positioned between a portion of the head and a portion of the shaft of the tool. The resilient member dampens and absorbs vibration travelling from the head to the shaft and reverberations travelling through the tool. The exemplary embodiment of the shock absorption system further includes a shock-absorbing member having an internal portion positioned within a cavity in the head of the tool and an external portion positioned on an upper surface of the head. The resilient member dampens and absorbs vibration travelling within the head and reverberations travelling through the tool. The exemplary embodiment of the shock absorption system also includes a bonding material filling spaces with the cavity and a channel within the head. The bonding material further dampens and absorbs vibration travelling from the head to the shaft and reverberations travelling through the tool. The exemplary embodiment further includes a handle portion on the shaft that has a soft elastomeric outer coating that provides a comfortable grip to the user and hinders vibration from travelling from the shaft to the hand of the user. The shock absorption system of the present invention advantageously reduces vibrations in the shaft that can cause great discomfort to the user and can be detrimental to the health of the user.

Additional advantages and other features of the invention will be set forth in part in the description which follows and in part will become apparent to those having ordinary skill in the art upon examination of the following or may be learned from the practice of the invention. The advantages of the invention may be realized and obtained as particularly pointed out in the appended claims.

DETAILED DESCRIPTION OF THE INVENTION

The present invention provides a shock absorption system for a striking tool 10 that reduces the amount of vibration travelling from a head 12 of a striking tool 10 to a shaft 14. The exemplary embodiment of the striking tool 10 as depicted in FIGS. 1–9 is a hammer. The present invention is contemplated to be used with any type of striking tool having a head portion and a shaft portion, for example, sledgehammers, axes, picks, etc., and is not limited to use with hammers.

Figure 1:
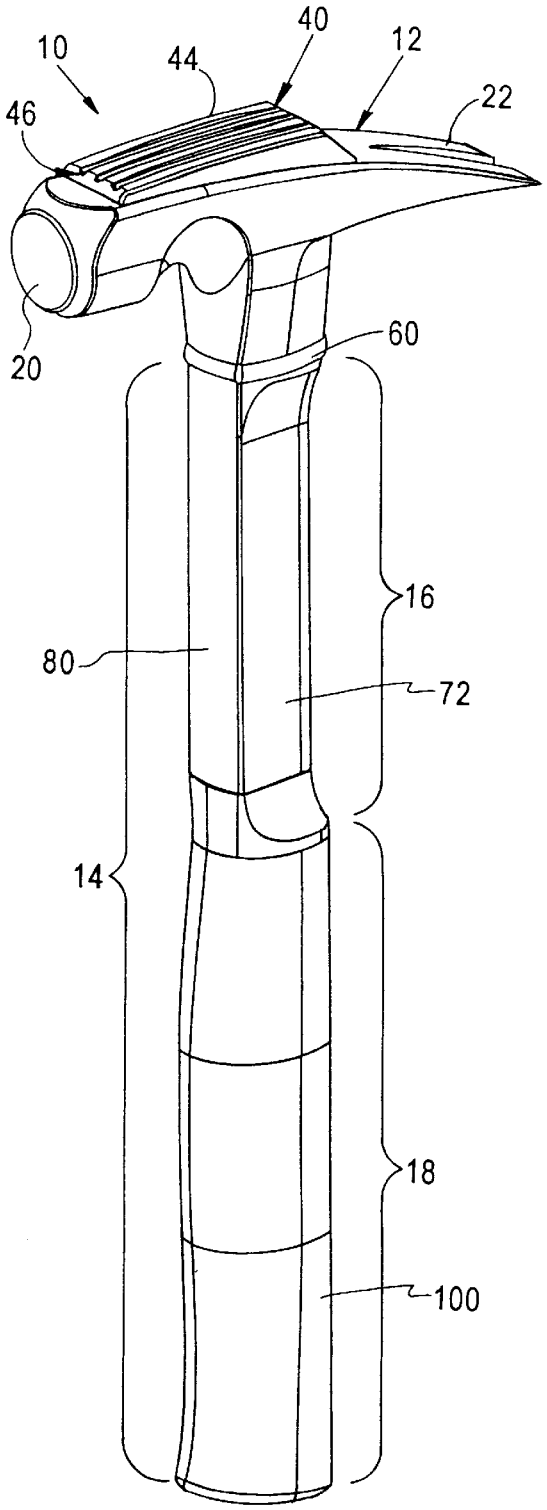
FIG. 1 is a front perspective view of an exemplary embodiment of a striking tool according to the present invention.
Figure 2:
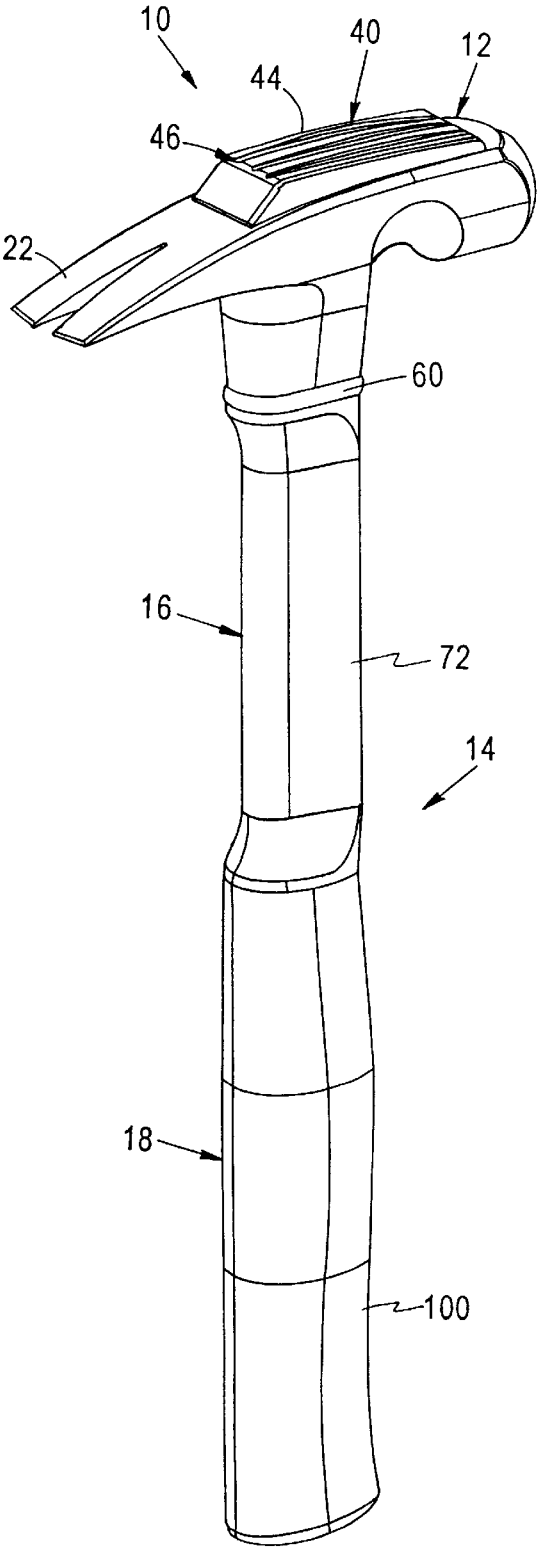
FIG. 2 is a rear perspective view of the exemplary embodiment of a striking tool according to the present invention.
Figure 3:
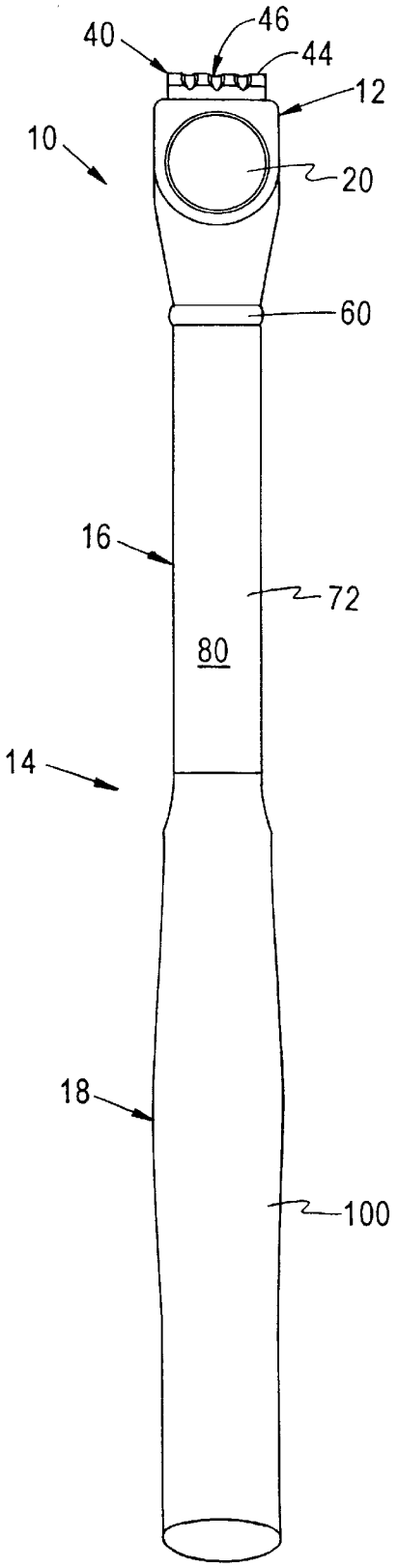
FIG. 3 is a front view of the exemplary embodiment of a striking tool according to the present invention.
Figure 4:
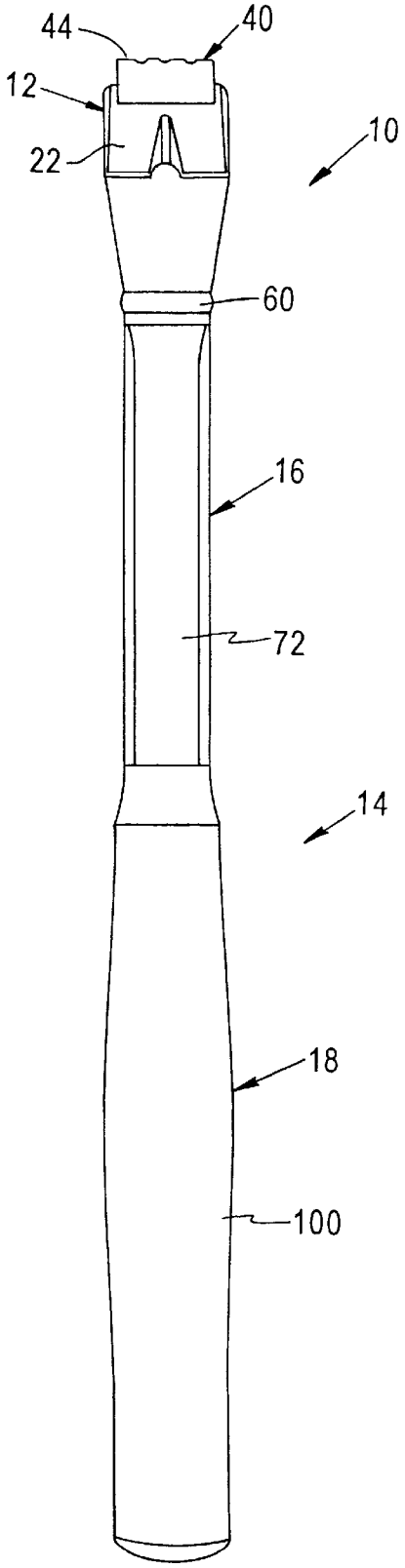
FIG. 4 is a rear view of the exemplary embodiment of a striking tool according to the present invention.
Figure 5:
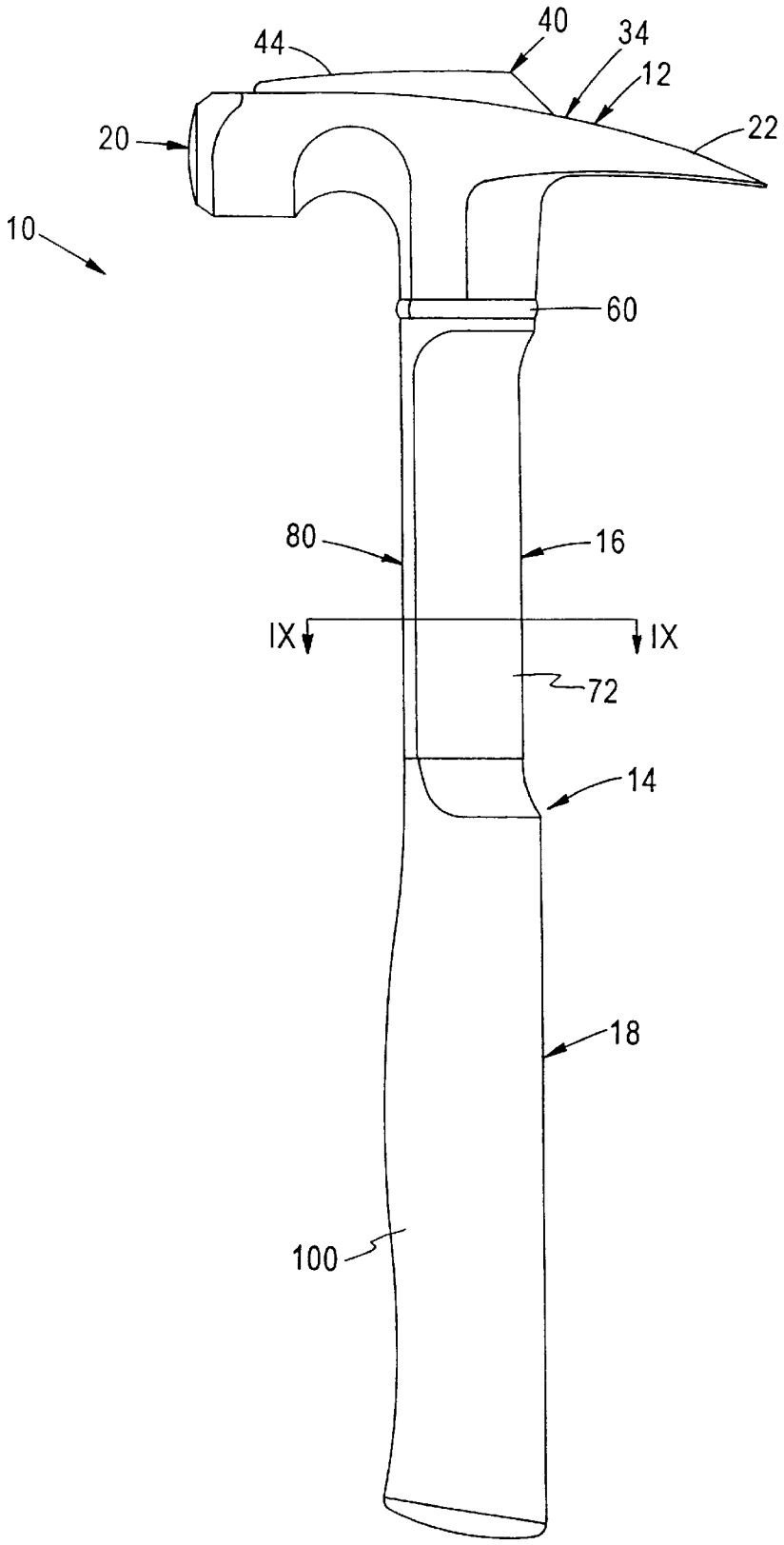
FIG. 5 is a right side view of the exemplary embodiment of a striking tool according to the present invention.
Figure 6:
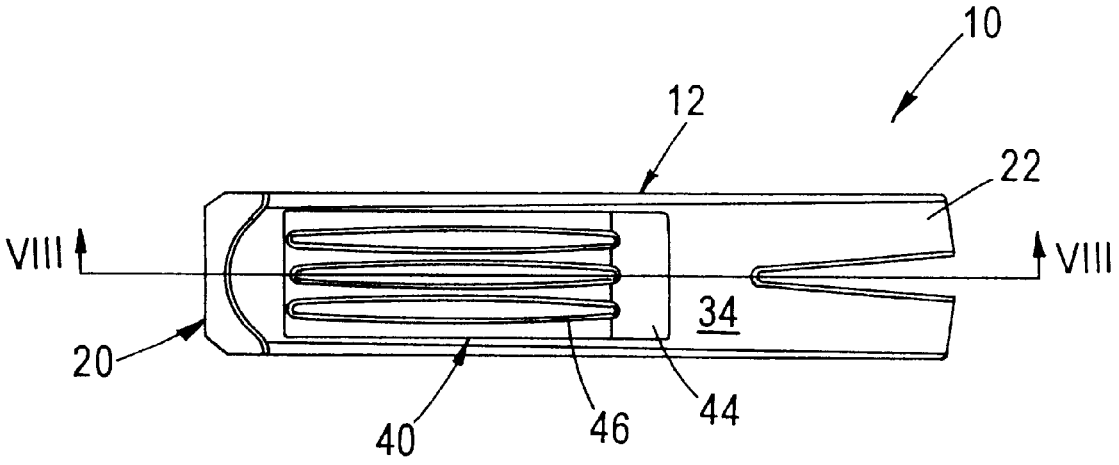
FIG. 6 is a top view of the exemplary embodiment of a striking tool according to the present invention.
Figure 7:
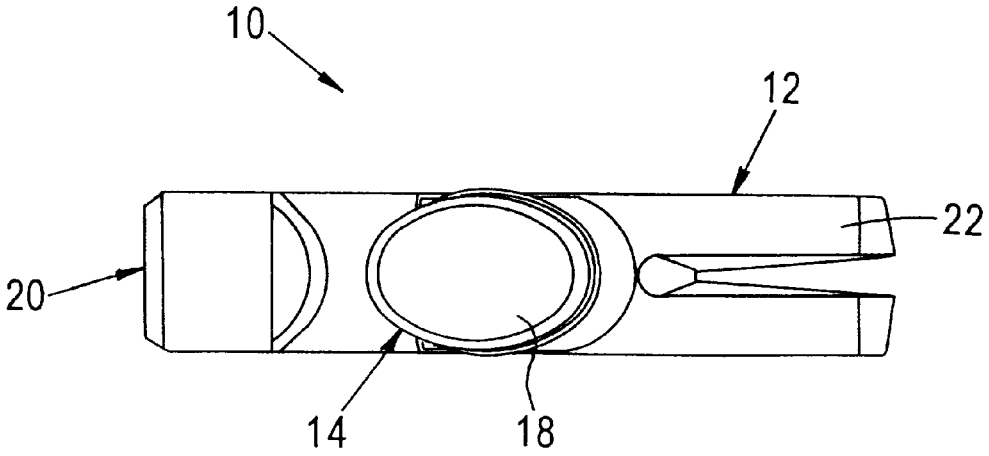
FIG. 7 is a bottom view of the exemplary embodiment of a striking tool according to the present invention.
Figure 8:
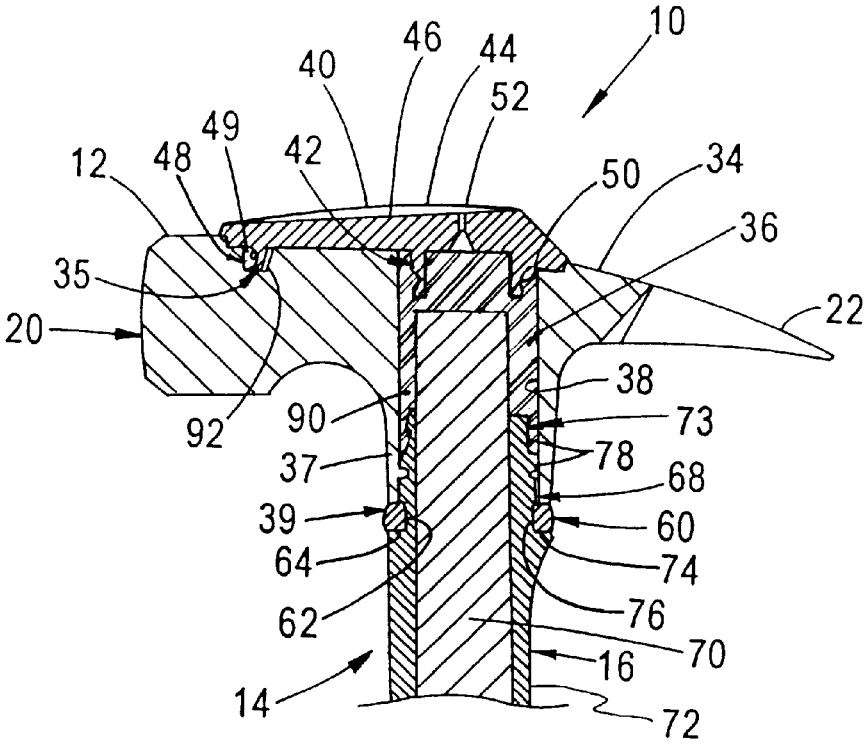
FIG. 8 is a cross-sectional view of the striking tool, depicting an exemplary embodiment of a shock absorption system according to the present invention, taken along line VIII—VIII in FIG. 6.
Figure 9:
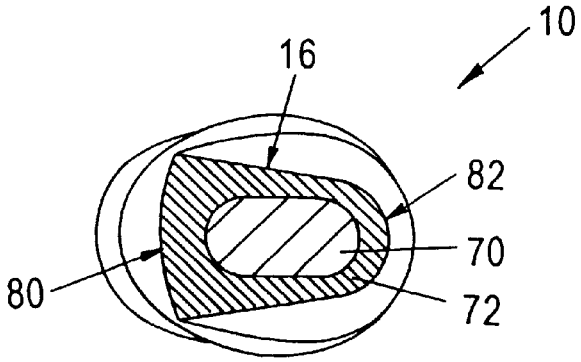
FIG. 9 is a cross-sectional view of the striking tool, depicting a cross-section of a shank of the striking tool, taken along line IX—IX in FIG. 5.

The striking tool 10 depicted in FIGS. 1–9 includes a head 12 connected to a shaft 14. The shaft 14 of the exemplary embodiment includes a shank portion 16, or neck portion, and a handle portion 18. The shank portion 16 generally extends between the head 12 of the striking tool 10 and the handle portion 18. The head 12 is preferably made of drop-forged high-carbon steel. The shaft 14 includes an inner core 70 made of fiberglass (see FIG. 8) that extends through the shank portion 16 and the handle portion 18. The inner core 70 preferably has a hard plastic outer layer 72 along the shank portion 16 and a soft elastomeric outer coating 100 along the handle portion 18. The outer coating 100 is preferably made of Santoprene™ having a hardness grade ranging from 50 to 55 Shore A. The outer coating 100 provides a comfortable grip to the user and hinders vibration from travelling from the shaft 14 to the hand of the user. The materials described above are merely exemplary, and one skilled in the art will recognize that other suitable materials may alternatively be used. The handle portion 18 is ergonomically shaped and has a teardrop shape when viewed in cross-section with a narrow end on the same side of the tool 10 as a contact surface 20 of the head 12 and a broad end on the same side of the tool 10 as a claw portion 22 of the head 12, as seen in FIG. 9.

Occasionally during the use of a striking tool 10 the user may fail to make contact with an intended object and may instead strike and mar an unintended object or surface. The shank portion 16 of the exemplary embodiment has a cross-sectional shape that reduces damage caused to a surface accidentally struck by the shank portion 16 of the tool 10. Referring to FIG. 9, the outer layer 72 of the shank has a cross-sectional shape having a broad surface 80 aligned with a contact surface 20 of the head 12 and a narrow surface 82 aligned with a claw portion 22 of the head 12. The broad surface 80 is aligned with the contact surface 20 of the head so that if the user fails to make contact between the contact surface 20 and the intended object, then the broad surface 80 of the shank portion 16 will strike the unintended object. When the broad surface 80 strikes an object, the broad surface 80 will distribute the force over a larger area on the object than would a narrow surface. By distributing the force over a large area, the broad surface 80 will produce a less intrusive mark on the object. The broad surface 80 preferably has a width that is substantially equal to (as depicted) or greater than a width of the contact surface 20 of the head 12.

Referring to FIG. 8, the head 12 of the striking tool 10 includes a contact surface 20 at one end and a claw portion 22 at an opposing end. The contact surface 20 of the exemplary embodiment is used as a surface with which an object is struck. The claw portion 22 of the exemplary embodiment is generally a V-shaped protrusion that extends away from the contact surface 20 and bends slightly downwards. The head 12 further includes an upper surface 34, and a cavity 36 that preferably extends downward from the upper surface 34 through the head 12. The lower portion of the cavity 36 is defined by a sleeve-like portion 37 that is used to connect the handle 14 with the head 12. The sleeve-like portion 37 defining the lower portion of the cavity 36 generally includes an inner surface 38 and a lower edge 39.

The shock absorption system of the present invention preferably includes a shock-absorbing member 40 having an internal portion 42 that extends within the cavity 36 in the head 12. The internal portion 42 includes a groove 50 that extends around an outer lower edge thereof that helps to grip hardened bonding material 94 inserted within the cavity 36 to fix the shock-absorbing member 40 to the head 12. The shock-absorbing member 40 further includes an external portion 44 that rests upon the upper surface 34 of the head 12. The shock-absorbing member 40 includes a lip 48 protruding from a bottom surface of the external portion 44 and into a channel 35 in the head 12. The channel 35 and the lip 48 have a generally U-shaped pattern (not depicted) when viewed from the top that begins and ends at the cavity 36. The lip 48 has a groove 49 on an outer surface thereof that helps to grip hardened bonding material 94 inserted within the channel 35 to fix the shock-absorbing member 40 to the head 12. The shock-absorbing member 40 includes a series of parallel grooves 46 that extend in a direction generally perpendicular to the contact surface 20 of the head 12. The shock-absorbing member 40 also includes an aperture 52 that allows air to escape from the cavity 36 when the cavity 36 is filled with bonding material 94 and the shock-absorbing member 40 is positioned within the cavity during manufacturing of the striking tool 10.

The shock-absorbing member 40 serves several purposes, such as absorption of vibration in the head 12, configuration as both a "ripping hammer" and a "claw hammer," and prevention of marring of walls or wood surfaces when pulling nails. The shock-absorbing member 40 provides an important function of absorbing vibration travelling through the head 12 when the head 12 is struck against a hard object, as well as absorbing any vibrations reverberating in the head 12 after the initial shock. Note that the downward angle of the claw portion 22 from a horizontal plane when viewed in FIG. 8 is generally less than twenty degrees. The relatively small downward angle of the claw portion 22 allows the exemplary embodiment of the present invention to be used as a "ripping hammer." Ripping hammers generally have claw portions 22 with small downward angles so that the claw portion 22 can be easily thrust through material such as drywall and used to pry the drywall off the wall to which it is attached. The shock-absorbing member 40 has a generally wedge-like shape and extends above the upper surface 34 of the head 12, thereby providing a raised surface that provides a larger downward angle for the claw portion 22 which allows the exemplary embodiment of the present invention to be used as a "claw hammer." Claw hammers generally have claw portions 22 with large downward angles (for example, greater than twenty degrees) so that the claw portion 22 can be easily used to provide proper leverage and therefore proper mechanical efficiency to the claw portion 22 when the claw portion 22 is used to pry nails from a surface. In order to use the exemplary embodiment as a claw hammer the shock-absorbing member 40 is placed on a wall or other surface adjacent the nail, the claw portion 22 is engaged with the nail, and the shaft 14 is pulled away from the nail. The shock-absorbing member 40 is preferably made of an elastomer such as Santoprene™ having a hardness grade ranging from 40 to 80 Shore A, with a preferred value of 70 Shore A. The soft elastomer absorbs vibration and allows the shock-absorbing member 40 to prevent marring of the wall or other surface it is placed against during the prying of a nail.

Note that the shock-absorbing member 40 is a preferred feature of the present invention, but if it is not included in a particular embodiment then the cavity 36 does not need to extend through the head 12 to the upper surface 34 of the striking tool 10.

In the exemplary embodiment of the present invention, the shank portion 16 of the shaft 14 includes a protruding portion 73 that extends within and is attached to the cavity 36 of the head 12. The protruding portion 73 includes a lower seat surface 74 and a side seat surface 76 that define a recessed seat upon which is positioned a resilient member 60. The protruding member further includes a series of protruding surfaces 78 that extend outward from the protruding portion 73, which provide surfaces that help the protruding portion 73 grip hardened bonding material 94 inserted within the channel 35 to fix the shaft 14 to the head 12.

The resilient member 60 is an important feature of the shock absorption system of the present invention. The exemplary embodiment of the resilient member depicted in FIG. 8 is a generally O-shaped ring made of an elastomer such as Santoprene™ having a hardness grade ranging from 40 to 80 Shore A, with a preferred value of 70 Shore A. The resilient member 60 is positioned about the protruding portion 73 of the shaft 14. The resilient member 60 rests within a recessed seat defined by the lower seat surface 74 and the side seat surface 76. The resilient member 60 includes a inner surface 62 that contacts the side seat surface 76 and a lower surface 64 that contacts the lower seat surface 74. The resilient member 60 is generally positioned between a portion of the head 12 and a portion of the shaft 14. For example, in the exemplary embodiment, the resilient member 60 is positioned between the lower edge 39 of the sleeve-like portion 37 of the head 12 and the lower seat surface 74 of the protruding portion 73 of the shaft 14. Preferably, the resilient member 60 further includes a lip 68 that extends between a portion of the inner surface 38 of the sleeve-like portion 37 of the head 12 and a portion of the side seat surface 76 of the protruding portion 73 of the shaft 14.

The head 12 is connected to the shaft 14 by positioning the resilient member 60 about the protruding portion 73 of the shaft 14 and within the recessed seat defined by the lower seat surface 74 and the side seat surface 76. The head 12 is positioned such that the lower edge 39 of the sleeve-like portion 37 is in contact with the resilient member 60 and the contact surface 20 is in proper alignment with the handle portion 18 of the shaft 14. Spaces 90 within the cavity 36 and spaces 92 within the channel 35 are filled with any suitable bonding material 94, for example epoxy. The shock-absorbing member 40 is positioned such that the external portion 44 is flush with the upper surface 34 of the head 12, and the lip 48 is within the channel 35 and the internal portion 42 is within the cavity 36. Any excess air or bonding material 94 within the cavity 36 is forced out the aperture 52 in the shock-absorbing member 40. Once the bonding material 94 hardens the head 12 is connected to the shaft 14 by the bond between the bonding material 94 and the head 12 and shaft 14, with help from the series of protruding surfaces 78 that extend outward from the protruding portion 73.

The present invention advantageously provides a shock absorption system for a striking tool 10 that reduces the amount of vibration travelling from the head 12 of a striking tool 10 to the shaft 14. The present invention accomplishes this result by positioning a resilient member 60 between a portion of the head 12 and a portion of the shaft 14 of the tool 10. The resilient member 60 dampens and absorbs vibration travelling from the head 12 to the shaft 14 and reverberations travelling through the tool 10. The exemplary embodiment of the shock absorption system further includes a shock-absorbing member 40 having an internal portion 42 positioned within a cavity 36 in the head 12 of the tool 10 and an external portion 44 positioned on an upper surface 34 of the head 12. The resilient member 40 dampens and absorbs vibration travelling within the head 12 and reverberations travelling through the tool 10. And finally, the exemplary embodiment of the shock absorption system further includes a bonding material 94 filling spaces 90 and 92 with the cavity 36 and a channel 35 within the head 12, respectively. The bonding material 94 further dampens and absorbs vibration travelling from the head 12 to the shaft 14 and reverberations travelling through the tool 10. The shock absorption system of the present invention advantageously reduces vibrations in the shaft 14 that can cause great discomfort to the user and can be detrimental to the health of the user.

In the previous descriptions, numerous specific details are set forth, such as specific materials, structures, processes, etc., in order to provide a thorough understanding of the present invention. However, as one having ordinary skill in the art would recognize, the present invention can be practiced without resorting to the details specifically set forth. In other instances, well known processing structures have not been described in detail in order not to unnecessarily obscure the present invention.

Only the preferred embodiment of the invention and an example of its versatility are shown and described in the present disclosure. It is to be understood that the invention is capable of use in various other combinations and environments and is capable of changes or modifications within the scope of the inventive concept as expressed herein.

What is claimed is:

1. A shock absorption system for a striking tool having a head, and a shaft connected to the head, said system comprising:

a resilient member configured to be positioned between a portion of the head and a portion of the shaft to absorb vibration created when the head is struck against an object and to hinder the vibration from travelling from the head to the shaft and a shock absorbing member configured to be affixed within a cavity in the head to absorb vibration within the head created when the head is struck against the object.

2. The shock absorption system according to claim 1, wherein said resilient member is made of an elastomeric material having a hardness grade in a range of about 45 to about 80 Shore A.

3. The shock absorption system according to claim 2, wherein said elastomeric material has a hardness grade of about 70 Shore A.

4. The shock absorption system according to claim 1, wherein said resilient member is generally O-shaped with a lip projecting from a top surface thereof, said lip adapted to extend between an inner surface of the head and an exterior surface of the shaft.

5. The shock absorption system according to claim 1, wherein said shock-absorbing member includes an external portion that protrudes from the cavity and extends along an upper surface of the head.

6. The shock absorption system according to claim 5, wherein said external portion of said shock-absorbing member includes a surface having grooves extending in a direction generally perpendicular from a contact surface of the head.

7. The shock absorbing system according to claim 1, wherein open space within the cavity in the head is filled with a shock-absorbing material.

8. A striking tool comprising:

a head;

a shaft connected to the head;

a resilient member configured to be positioned between a portion of the head and a portion of the shaft to absorb vibration created when the head is struck against an object and to hinder the vibration from travelling from the head to the shaft; and a shock absorbing member configured to be affixed within a cavity in the head to absorb vibration within the head created when the head is struck against the object.

9. The striking tool according to claim 8, wherein said resilient member is made of an elastomeric material having a hardness grade in a range of about 45 to about 80 Shore A.

10. The striking tool according to claim 9, wherein said elastomeric material has a hardness grade of about 70 Shore A.

11. The striking tool according to claim 8, wherein said resilient member is positioned within a seat portion on an outer surface of a protruding portion of said shaft and a lower edge of said head abuts a side of said resilient member.

12. The striking tool according to claim 8, wherein said resilient member is generally O-shaped with a lip projecting from a top surface thereof, said lip extending between an inner surface of said head and an exterior surface of said shaft.

13. The striking tool according to claim 8, wherein said shock-absorbing member includes an external portion that protrudes from said cavity and extends along an upper surface of said head.

14. The striking tool according to claim 13, wherein said external portion of said shock-absorbing member includes a surface having grooves extending in a direction generally perpendicular to a contact surface of said head.

15. The striking tool according to claim 8, wherein open space within said cavity in said head is filled with a shock-absorbing material.

16. The striking tool according to claim 8, wherein said shaft has a shank portion with a side having a broad surface aligned with a contact surface of said head, said broad surface having a width substantially equal to a width of said contact surface of said head.

17. The striking tool according to claim 8, wherein said shaft has a handle portion with an elastomeric coating.

18. The striking tool according to claim 8, wherein:

said striking tool is a hammer;

said head has a claw end configured as a ripping hammer; and said external portion of said shock-absorbing member protrudes above said upper surface of said head whereby said external portion allows said tool to be used as a claw hammer.

* * * * *